US010466019B1

(12) United States Patent
Arnon et al.

(10) Patent No.: US 10,466,019 B1
(45) Date of Patent: Nov. 5, 2019

(54) METHOD FOR APPLYING IDENTIFICATION MARKS TO A BULLET TIP DURING AMMUNITION MANUFACTURING PROCESS

(71) Applicant: Hernon Manufacturing, Inc., Sanford, FL (US)

(72) Inventors: Harry Arnon, Sanford, FL (US); Josef Arnon, Sanford, FL (US)

(73) Assignee: HERNON MANUFACTURING, INC., Sanford, FL (US)

( * ) Notice: Subject to any disclaimer, the term of this patent is extended or adjusted under 35 U.S.C. 154(b) by 4 days.

(21) Appl. No.: 15/656,036

(22) Filed: Jul. 21, 2017

Related U.S. Application Data

(60) Provisional application No. 62/365,570, filed on Jul. 22, 2016.

(51) Int. Cl.
*F42B 5/02* (2006.01)
*F42B 33/14* (2006.01)
*B41F 17/28* (2006.01)

(52) U.S. Cl.
CPC ..... *F42B 5/025* (2013.01); *B41F 17/28* (2013.01); *F42B 33/14* (2013.01)

(58) Field of Classification Search
CPC ..... B41F 17/28; B41F 17/001; B41F 17/20; B41F 17/14; F42B 5/025
USPC ..... 101/36, 41
See application file for complete search history.

(56) References Cited

U.S. PATENT DOCUMENTS 6,135,654 A * 10/2000 Jennel ..... B41J 2/01 101/35
6,209,459 B1 * 4/2001 Kaufman ..... F42B 5/025 102/439
6,293,204 B1 * 9/2001 Regen ..... F42B 5/025 102/430
6,672,219 B2 * 1/2004 Mackerell ..... F42B 5/025 102/430
6,810,816 B2 11/2004 Rennard
7,143,697 B2 12/2006 Mace et al.
7,823,495 B2 * 11/2010 Martini Filho ..... F42B 5/025 42/1.01
8,607,707 B1 12/2013 Arnon et al.
9,052,176 B1 * 6/2015 Stefano ..... F42B 33/14
2001/0047729 A1 * 12/2001 Maude ..... B41J 3/4073 101/35
2004/0169690 A1 * 9/2004 Morton ..... B41J 3/4073 347/4
2005/0045056 A1 * 3/2005 EkenediliChukwu .... F42B 5/02 102/430

(Continued)

*Primary Examiner* — Leslie J Evanisko
(74) *Attorney, Agent, or Firm* — Allen Dyer Doppelt & Gilchrist, PA

(57) ABSTRACT

A system for printing a bullet tip identification includes a bullet support apparatus for holding and rotating a bullet about its longitudinal axis and a print head configured to be positioned in close proximity to a tip of a bullet. The print head is configured to apply an identification around the circumference of the bullet tip while the bullet is rotating about its longitudinal axis. A method of applying identification marks on bullet tip includes positioning a bullet tip in close proximity to a print head and rotating the bullet about a longitudinal axis of the bullet. An identification mark is then applied around the circumference of the bullet tip by the print head as the bullet rotates.

8 Claims, 4 Drawing Sheets

(56) References Cited

U.S. PATENT DOCUMENTS

2008/0218542 A1* 9/2008 Tezuka ..... B41J 3/4073
347/8
2016/0216087 A1* 7/2016 Raemy ..... F42B 5/025

* cited by examiner

METHOD FOR APPLYING IDENTIFICATION MARKS TO A BULLET TIP DURING AMMUNITION MANUFACTURING PROCESS

CROSS-REFERENCE TO RELATED APPLICATION

This application claims the benefit of U.S. Provisional Patent Application Ser. No. 62/365,570, filed on Jul. 22, 2016, the contents of which are herein incorporated by reference in their entirety.

FIELD OF THE INVENTION

The present invention relates to ammunition, and more particularly, to systems and methods for applying identification paint to bullet tips.

BACKGROUND OF THE INVENTION

There are many different types of ammunition manufactured. To give just a few examples, there are tracer rounds, armor piercing incendiary rounds, high explosive rounds, and training rounds (and combinations of these and other types). It can be difficult to readily distinguish between different types of rounds simply from the appearance of the cartridge. Consequently, marking requirements are often put in place to allow those handling and using ammunition to quickly determine the type of round. Most commonly, this takes the form of colored paint applied to the tip of the bullet.

In the ammunition manufacturing process, bullet tip identification painting is ordinarily performed after the bullet is sealed into the case. While significant improvements have been made in the rate at which cartridges can be assembled (for instance, using automatic sealing systems like those offered by Hernon Manufacturing, Inc.), the application of paint to the bullet tip has remained a relatively slow, batch process.

Generally, a group of cartridges is held with bullet tips facing down and dipped in a container of paint to a predetermined depth. The paint must then be allowed to dry before the cartridges can be packaged. Where the type of cartridge dictates multiple color bands on the tip, the delay is correspondingly multiplied. The color band most distant from the tip is applied first, with the cartridges being dipped to a greater depth in this color. After drying, the cartridges are dipped to a shallower depth in the next color, which must then also dry. If a third color is needed, a third iteration of this must occur.

Thus, while equipment exists to allow the filling, assembling and sealing of cartridges at a rapid pace, bullet tip identification painting can often be a choke point for ammunition throughput.

SUMMARY OF THE INVENTION

In view of the foregoing, it is an object of the present invention to provide improved systems and methods for printing a bullet tip identification mark.

According to one embodiment of the present invention, a system for printing a bullet tip identification includes a bullet support apparatus for holding and rotating a bullet about its longitudinal axis and a print head configured to be positioned in close proximity to a tip of a bullet. The print head is configured to apply an identification around the circumference of the bullet tip while the bullet is rotating about its longitudinal axis.

According to another embodiment of the present invention, a method of applying identification marks on bullet tip includes positioning a bullet tip in close proximity to a print head and rotating the bullet about a longitudinal axis of the bullet. An identification mark is then applied around the circumference of the bullet tip by the print head as the bullet rotates.

These and other objects, aspects and advantages of the present invention will be better appreciated in view of the drawings and following detailed description of preferred embodiments.

DETAILED DESCRIPTION OF PREFERRED EMBODIMENTS

In the summary of the Invention above and in the description of certain preferred embodiments, reference is made to particular features (including method steps) of the invention. It is to be understood that the disclosure of the invention in this specification includes all possible combinations of such particular features, regardless of whether a combination is explicitly described. For example, where a particular feature is disclosed in the context of a particular aspect or embodiment of the invention, that feature can also be used, to the extent possible, in combination with and/or in the context of other particular aspects and embodiments of the invention, and in the invention generally.

Embodiments of the invention are described herein in connection with conventional ammunition cartridges such as those that can be fired from a rifel or handgun. In this context, the drawings illustrate these embodiments by showing small caliber ammunition cartridges. It is to be understood, however, that the invention is not limited to the special size or shape ammunition cartridge that is described. The invention may be adapted as desired for use with any size or shape ammunition cartridge. The invention may also be used in on other parts of ammunition cartridge other than bullet tips.

Figure 1:
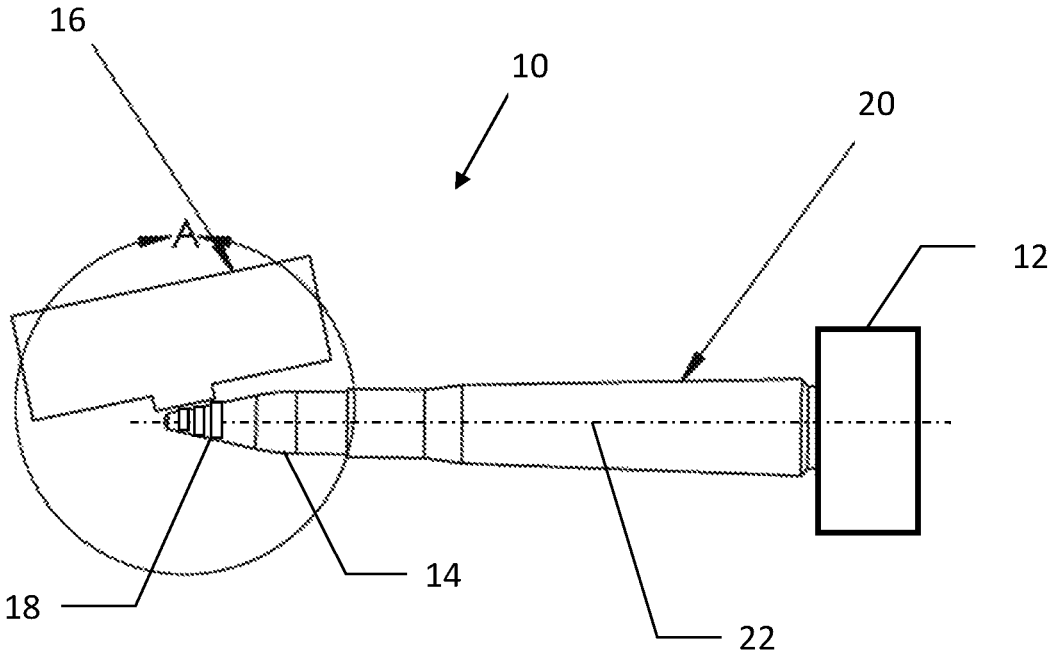
FIG. 1 is a schematic view of a system for applying a bullet tip identification mark.
Figure 2:
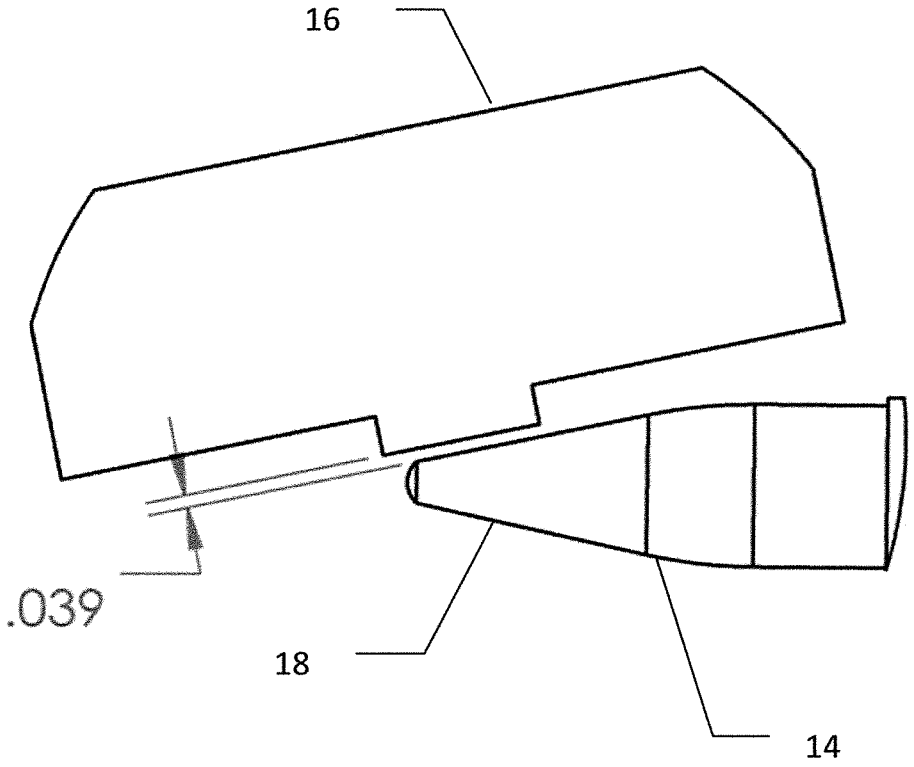
FIG. 2 is a detail view of area A of FIG. 1.

Referring to FIGS. 1 and 2, according to an embodiment of the present invention, a system 10 for printing a bullet tip identification includes a bullet support apparatus 12 for holding and rotating a bullet 14 about its longitudinal axis. A print head 16 is configured to be positioned in close proximity to a tip 18 of a bullet 14. The print head 16 is configured to apply paint around the circumference of the bullet tip 18 while the bullet 14 is being rotated about its longitudinal axis. In the depicted embodiment, the print head 16 is positioned such that the bullet tip 18 passes thereunder and the distance between the print head 16 and the circumference of the bullet tip 18 is about 0.039 inches (or 1 mm). Other suitable arrangement can be used. Preferably, a cartridge 20 including the bullet 14 is held horizontally, or approximately horizontally, and supported such that when the bullet 14 rotates about its longitudinal axis 22, the print head 16 can apply paint around the circumference of the bullet tip 18 to form an identification mark. As an example, the identification mark includes one or more color bands in order to identify or differentiate types of ammunition. As another example, the identification mark can also include one or more letters, words, numbers, symbols, designs, logos or the like.

The bullet support apparatus 12 can be configured to hold one or more bullets to be painted in a batch. The bullet support apparatus 12 includes a rotating element configured for rotating the bullet 14 or cartridge 20. The bullet support apparatus 12 can further be configured to translate the bullet 14 or cartridge 20 along its longitudinal axis 22 during paint application to increase coverage of identification area. Alternatively, the bullet support apparatus 12 makes little or no translational movement for the print head 12 or cartridge 20 in the direction of the longitudinal axis 22.

The print head 16 can be selected from a variety of suitable type of printing head, including, but not limited to, spray heads and contact/pad heads. Spray print head is configured to spray ink from tiny nozzles onto the tip of bullet in a controlled manner. The contact/pad head is configured to pressing ink in direct contact with the tip of the bullet.

Advantageously, the print head 12 is configured to print a plurality of colors simultaneously or near-simultaneously—for example, a spray head with multiple nozzles, or contact/pad head with multiple separate pads.

The print head 16 can be configured to supply a plurality of different paint types, although UV-curable paint represents a most preferred embodiment. Where UV-curable paint is applied, the cartridge 20 is then advanced to a UV-curing machine after the tip identification has been applied. The print header 16 can also be an UV-LED print head to increase UV curing time. The speed of this process thereby allows the paint tip identification application to be part of a continuous or near-continuous ammunition manufacturing process.

The print head 16 can also be configured to be stationary or make a translational move along the longitudinal axis 22 of the bullet 14 or cartridge 20 during painting process. In addition, when the bullet support apparatus 12 holds a batch of bullets 14 in parallel, the print head 16 can also be configured to make a movement perpendicular or at an angle to the longitudinal axis of the bullet 14 or cartridge 20 to paint the batch of bullets simultaneous or simultaneously.

Figure 3:
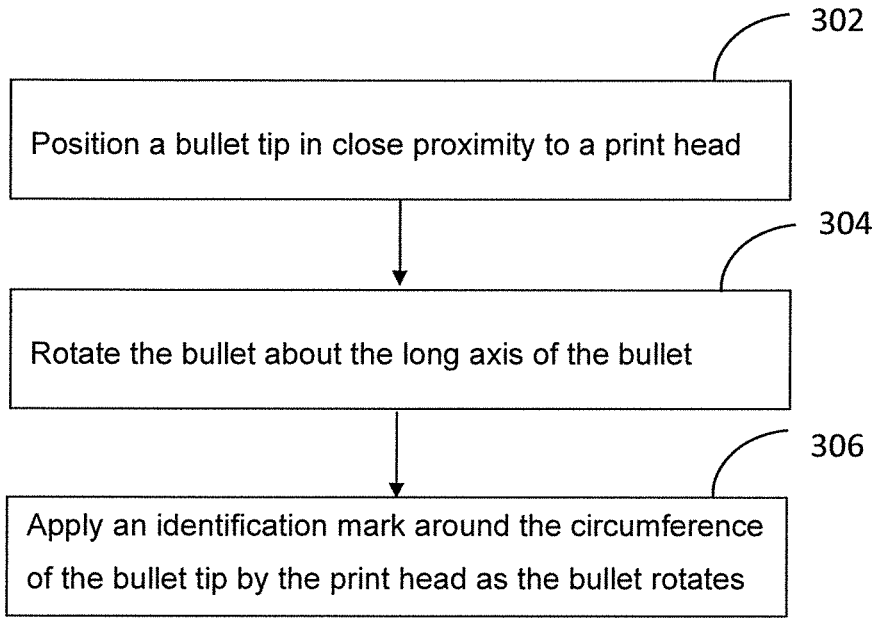
FIG. 3 is flowchart illustrating a method of applying a bullet tip identification.
Figure 4:
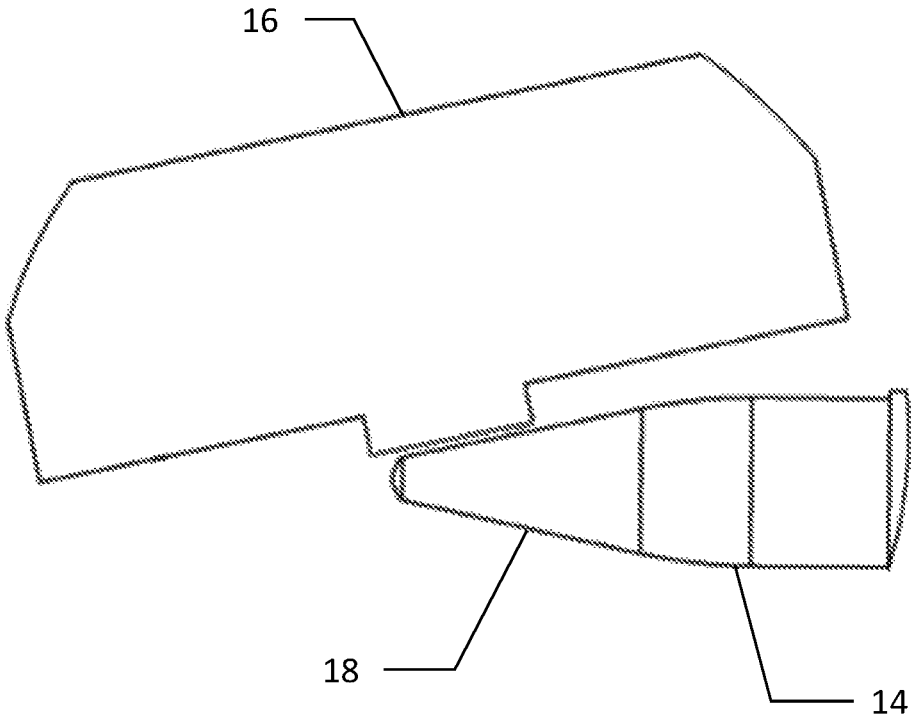
FIG. 4 is an alternate detail view of area A of FIG. 1.

Referring to FIG. 3, a method of applying identification marks on bullet tip includes positioning a bullet tip 18 in close proximity to a print head at step 302. At step 304, the bullet is rotated about a longitudinal axis 22 of the bullet 14. At step 306, an identification mark is applied around the circumference of the bullet tip 18 by the print head as the bullet 14 rotates.

Since paint tip identification is typically applied after sealing the bullet in the case, the system 10 is advantageously integrated into an automatic sealing machine proximate an exit station thereof. Alternately, the system 10 can be made as an independent machine that receives the cartridges (or components) thereof from an automatic sealing machine or other machine of an ammunition manufacturing line.

As noted above, different types of print heads could be advantageously used in connection with the present invention, and it could be implemented at various points in an ammunition manufacturing line. The above-described embodiment is provided for illustrative and exemplary purposes; the present invention is not necessarily limited thereto. Rather, those skilled in the art will appreciate that various modifications and adaptations to particular circumstances will fall within the scope of the invention herein shown and described.

The disclosed systems and methods can apply an identification mark simultaneously or nearly simultaneously, rather than one color band at a time. The disclosed system provides a much faster and efficient process for applying a bullet tip identification marks on the bullet.

The foregoing is provided for illustrative and exemplary purposes; the present invention is not necessarily limited thereto. Rather, those skilled in the art will appreciate that various modifications, as well as adaptations to particular circumstances, are possible within the scope of the invention as herein shown and described.

What is claimed is:

1. A method of applying identification marks on a bullet tip during an ammunition manufacturing process, the method comprising:

receiving a cartridge from an automatic sealing machine, the cartridge including a bullet sealed in a case;

positioning a bullet tip of the bullet in close proximity to a print head;

rotating the bullet about a longitudinal axis of the bullet;

applying UV-curable paint around the circumference of the bullet tip to form an identification mark by the print head as the bullet rotates; and advancing the catridge with the identification mark on the bullet tip to a UV-curing machine for UV curing of the identification mark.

2. The method of claim 1, wherein the bullet tip is positioned approximately horizontally.

3. The method of claim 1, wherein a plurality of colors are applied to the bullet tip simultaneously.

4. The method of claim 1, wherein the paint is applied by a spray print head.

5. The method of claim 1, wherein the paint is applied by a pad print head.

6. The method of claim 1, further comprising moving the print head along the direction of the longitudinal axis of the bullet while rotating the bullet tip.

7. The method of claim 1, further comprising moving the bullet tip along the direction of the longitudinal axis of the bullet while rotating the bullet tip.

8. The method of claim 1, further comprising advancing the cartridge with the identification mark on the bullet tip to an exit station of the automatic sealing machine.

* * * * *